US008303341B2

(12) United States Patent
Won et al.

(10) Patent No.: US 8,303,341 B2
(45) Date of Patent: Nov. 6, 2012

(54) CONNECTOR AND DISPLAY APPARATUS HAVING THE SAME

(75) Inventors: Joo-Yeon Won, Seoul (KR); OckJin Kim, Asan-si (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 0 days.

(21) Appl. No.: 13/323,250

(22) Filed: Dec. 12, 2011

(65) Prior Publication Data

US 2012/0094510 A1 Apr. 19, 2012

Related U.S. Application Data

(63) Continuation of application No. 12/787,420, filed on May 26, 2010, now Pat. No. 8,075,340.

(30) Foreign Application Priority Data

Nov. 5, 2009 (KR) ..... 10-2009-0106623

(51) Int. Cl.
*H01R 13/648* (2006.01)

(52) U.S. Cl. ..... 439/607.34

(58) Field of Classification Search ..... 439/607.34, 439/607.35, 607.36, 607.4, 607.53, 497, 439/579

See application file for complete search history.

(56) References Cited

U.S. PATENT DOCUMENTS

2009/0068860 A1* 3/2009 Suzuki et al. ..... 439/67

* cited by examiner

*Primary Examiner* — Ross Gushi

(74) *Attorney, Agent, or Firm* — F. Chau & Associates, LLC

(57) ABSTRACT

A connector includes female and male connectors. The female connector includes a housing having a groove recessed from a front surface of the housing, a signal terminal including a signal contact section provided at a first wall of the groove and an external connection section connected with the signal contact section and protruding out of the housing through a rear surface of the housing, and a grounding terminal including a grounding contact section provided at an opposing wall facing the first wall of the groove and a grounding connection section connected with the grounding contact section, the grounding connection section extending out of the groove at the front surface of the housing.

18 Claims, 8 Drawing Sheets

CONNECTOR AND DISPLAY APPARATUS HAVING THE SAME

CROSS-REFERENCE TO RELATED APPLICATION

This application is a Continuation Application of U.S. patent application Ser. No. 12/787,420 filed on May 26, 2010 now U.S. Pat. No. 8,075,340 which claims priority to Korean Patent Application No. 2009-106623 filed on Nov. 5, 2009, the disclosures of which are incorporated herein by reference in their entirety.

BACKGROUND OF THE INVENTION

1. Technical Field

The present invention relates to a connector and a display apparatus having the same.

2. Discussion of the Related Art

As an alternative to a cathode ray tube (CRT) display, various display apparatuses such as a liquid crystal display (LCD), a plasma display panel (PDP), and an electrophoretic display (EPD) have been used for computer monitors, televisions, and so on.

The display apparatuses include a display panel to display images. The display apparatuses may require a converter to convert image signals, which are generated from a controller controlling the images, into driving signals that are recognized by the display panel. The converter is connected with the controller through a connector.

As the size and the resolution of the display panel are increased, a large amount of signals are transmitted between the display panel and the controller through the connector.

SUMMARY OF THE INVENTION

The embodiments of the present invention provide a connector capable of stably transmitting a large amount of signals through a high-speed transmission scheme by reinforcing a ground of connector.

The embodiments of the present invention also provide a display apparatus having improved display quality by reinforcing a ground of the connector used in the display apparatus.

In one aspect, a connector according to an embodiment of the present invention includes a female connector and a male connector coupled with the female connector.

The female connector includes a housing having a groove recessed from a front surface of the housing, a signal terminal, and a grounding terminal.

The signal terminal includes a signal contact section provided at an inner wall of the groove and an external connection section connected with the signal contact section and protruding out of the housing through a rear surface of the housing. An end of the external connection section may be adjacent a bottom surface of the housing.

The grounding terminal includes a grounding contact section provided at an opposing wall facing the inner wall of the groove and a grounding connection section connected with the grounding contact section, the grounding connection section extending out of the groove at the front surface of the housing.

The grounding connection section has a plate-like shape, and is bent along an outer surface of the housing. The grounding connection section further includes a grounding terminal section protruding through an open portion of the grounding connection section at the front surface of the housing so that the grounding connection section protrudes from the front surface. The grounding terminal section may be adjacent a bottom surface of the housing.

A plurality of signal terminals may be arranged along the inner wall of the groove.

The housing is provided at an outside thereof with an outer skin surrounding the housing.

A projection of the male connector is inserted into the groove so that the male connector is coupled with the female connector. The male connector includes a signal supplying section and a grounding section. The signal supplying section makes contact with the signal contact section. The grounding section makes contact with the grounding contact section while being insulated from the signal supplying section.

A plurality of female connectors may be provided. The signal terminals may be arranged along the inner wall of the groove. A plurality of male connectors also may be provided. The number of the signal supplying sections of a male connector may correspond to the number of the signal terminals of a female connector.

The connector according to an embodiment of the present invention may be used in a display apparatus. The display apparatus having the connector includes a driving section generating a signal, a male connector connected with the driving section, a female connector coupled with the male connector to receive the signal from the driving section, a printed circuit board, and a display panel.

The printed circuit board includes the female connector mounted thereon and includes a driving circuit to receive the signal from the female connector to output a driving signal.

A display panel displays an image according to the driving signal.

The female connector includes a housing including a groove recessed from a front surface of the housing, a signal terminal, and a grounding terminal.

The signal terminal includes a signal contact section provided at an inner wall of the groove and an external connection section connected with the signal contact section and protruding out of the housing through a rear surface of the housing.

The grounding terminal includes a grounding contact section provided at an opposing wall facing the inner wall of the groove and a grounding connection section connected with the grounding contact section, the grounding connection section extending out of the groove at the front surface of the housing, and connecting with the printed circuit board.

The projection of the male connector is inserted into the groove of the female connector to transmit the signal to the female connector.

The connector having the above structure according to an embodiment of the present invention transmits electrical signals to a grounding section of an external device without delay. In addition, when comparing with a conventional connector, electromagnetic interference (EMI) is reduced. Accordingly, defects caused by the EMI are reduced, and electrical signal transmission of the connector is improved.

When using the connector according to an embodiment of the present invention in a display apparatus, an impedance value within a desirable range is obtained. Accordingly, signal transmission quality is stably maintained, so that display quality is improved.

BRIEF DESCRIPTION OF THE DRAWINGS

The embodiments of the present invention will become readily apparent by reference to the following detailed description when considered in conjunction with the accompanying drawings wherein.

DESCRIPTION OF THE EMBODIMENTS

Figure 1:
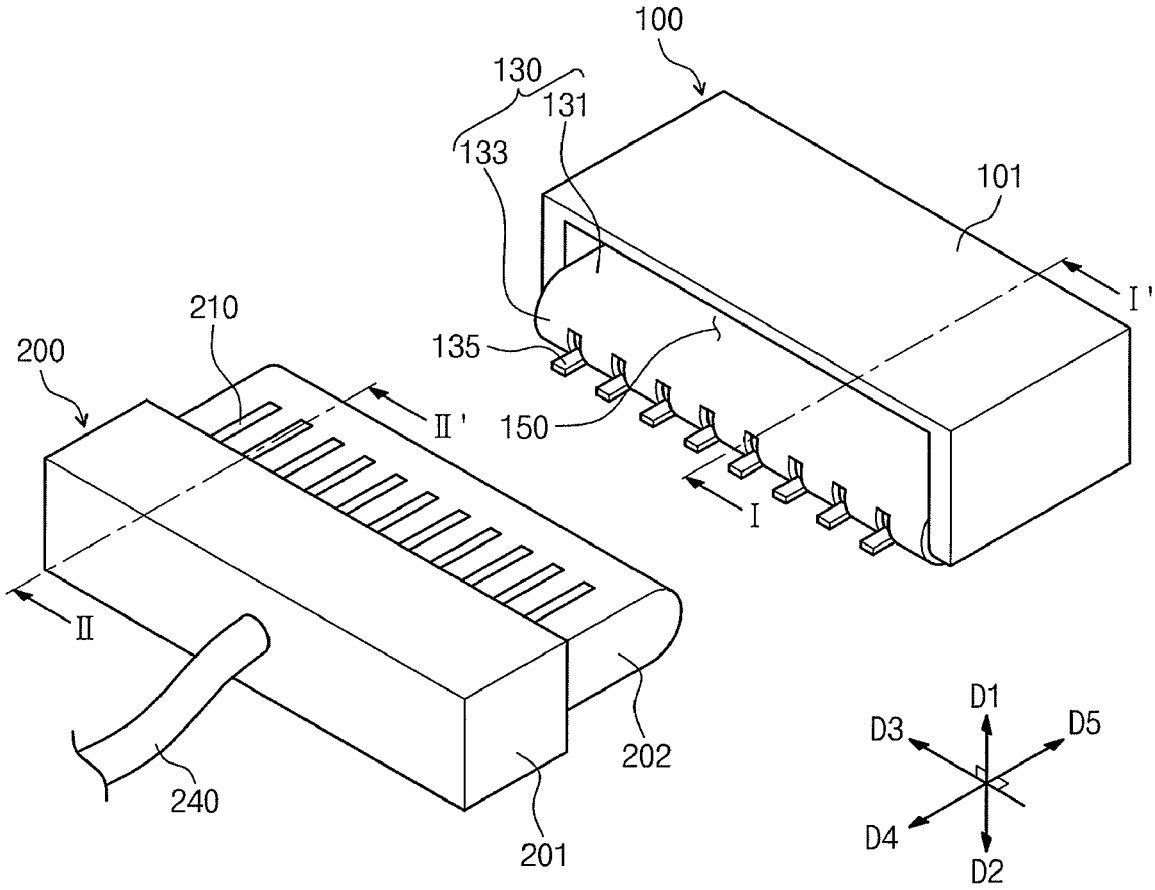
FIG. 1 is a perspective view showing a connector according to an embodiment of the present invention.

A connector for signal transmission and a display apparatus having the same according to embodiments of the present invention will be described with reference to accompanying drawings.

Exemplary embodiments of the invention are described more fully hereinafter with reference to the accompanying drawings. This invention may, however, be embodied in many different forms and should not be construed as limited to the embodiments set forth herein. In addition, the size of the layers and regions in the attached drawings may be simplified or exaggerated for purposes of explanation and the same reference numerals may represent the same components.

Figure 2A:
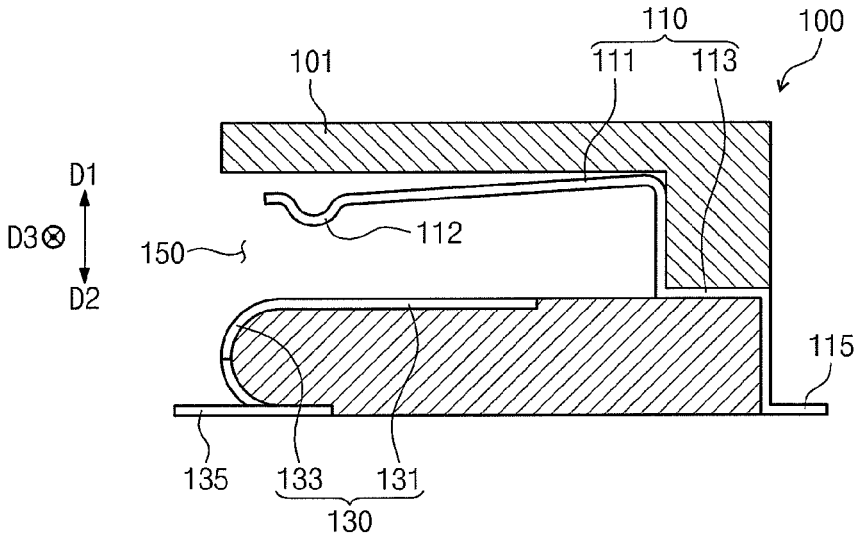
FIG. 2A is a sectional view taken along line I-I' of FIG. 1.
Figure 2B:
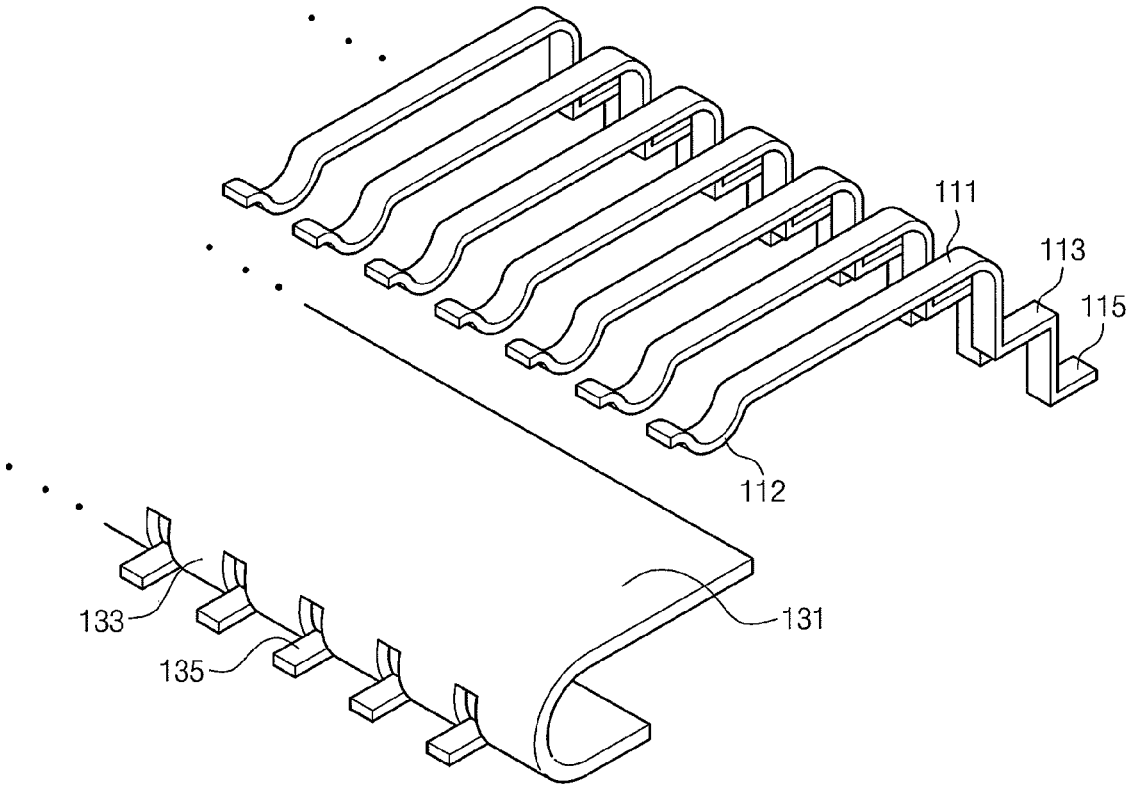
FIG. 2B is a perspective view showing a signal terminal and a grounding terminal of FIG. 2A.
Figure 3:
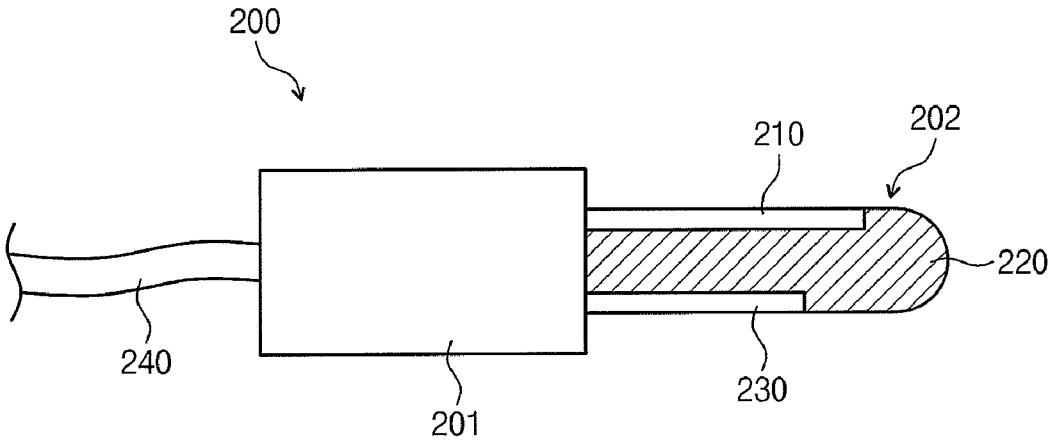
FIG. 3 is a sectional view taken along line II-II' of FIG. 1.
Figure 4:
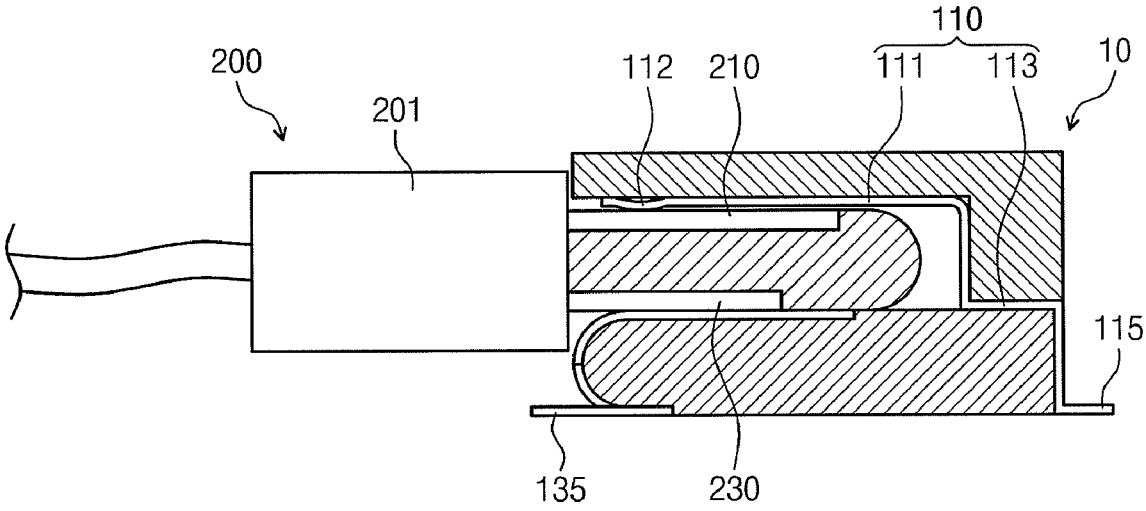
FIG. 4 is a sectional view showing the connection state of the connector according to an embodiment of the present invention.

FIG. 1 is a perspective view showing a connector according to an exemplary embodiment of the present invention. FIG. 2A is a sectional view taken along line I-I' of FIG. 1. FIG. 2B is a perspective view showing a signal terminal and a grounding terminal of FIG. 2A. FIG. 3 is a sectional view taken along line II-II' of FIG. 1. FIG. 4 is a sectional view showing the connection state of the connector according to an embodiment of the present invention.

In the present specification, for the purpose of explanation, an upper direction of the connector shown in drawings refers to a first direction D1, a direction opposite to the upper direction refers to a second direction D2, and a direction perpendicular to the first and second directions D1 and D2 and directed toward the upper left of the drawings from the lower right of the drawings refers to a third direction D3. When the first direction D1 is opposite to the second direction D2, the first and second directions D1 and D2 may be changed depending on the arrangement direction of the connector. Accordingly, the first and second direction D1 and D2 are not limited to the upper and lower directions.

Referring to FIGS. 1 to 4, the connector according to an embodiment of the present invention includes a female connector 100 and a male connector 200. The female connector 100 is formed therein with a groove 150 into which the projection 202 of the male connector 200 is inserted. The projection 202 of the male connector 200 is inserted into the groove 150 so that the male connector 200 is coupled with the female connector 100. Therefore, the male connector 200 is electrically connected with the female connector 100, so that signals can be transmitted therebetween.

Referring to FIGS. 1, 3, and 4, the male connector 200 includes a cable 240, a body 201 connected with the cable 240, and a projection 202 to stick out from the body 201 such that the projection 202 is inserted into the groove 150 of the female connector 100.

One end of the cable 240 is connected with an external device to supply an electrical signal, and the other end of the cable 240 is connected to the projection 202 through an inner part of the body 201.

The body 201 is made of an insulating material and supports the projection 202 therein.

The projection 202 includes a signal supplying section 210, a grounding section 230, and an insulating section 220.

The signal supplying section 210 is provided on a top side of the projection 202 and connected with the cable 240, so that the signal supplying section 210 supplies electrical signals to the female connector 100. The signal supplying section 210 extends from the body 201 in a projection direction of the projection 202. There may be a plurality of signal supplying sections 210. In this case, the signal supplying sections 210 are arranged in a row in the third direction D3.

The grounding section 230 is used for the purpose of grounding. When the female connector 100 is coupled with the male connector 200, the grounding section 230 makes contact with a grounding terminal 130 of the female connector 100. The grounding section 230 is provided on a bottom side of the projection 202. The grounding section 230 may be a single plate, but is not limited thereto. Alternatively, there may be a plurality of grounding sections 230. For example, the number of the grounding sections 230 may correspond to the number of the signal supplying lines 210. Each of the grounding sections 230 may have an identical shape with respect to each other.

The insulating section 220 insulates the signal supplying section 210 from the grounding section 230 while fixedly supporting the signal supplying section 210 and the grounding section 230.

Referring to FIGS. 1, 2A, 2B, and 4, the female connector 100 includes a housing 101, a signal terminal 110, and the grounding terminal 130. The signal terminal 110 transmits electrical signals, and the grounding terminal 130 grounds electrical signals. The housing 101 encloses the signal terminal 110 and the grounding terminal 130 in such a manner that the signal terminal 110 and the grounding terminal 130 are fixed to the inside of the housing 101.

The housing 101 includes an insulating material. The housing 101 may include various insulating materials without limitation to a specific type of an insulating material. The housing 101 includes insulating resin such as, for example, Teflon, polyethylene, or polypropylene. The parts of the housing 101 may be integrally formed. Alternatively, the housing 101 may be formed by assembling pieces of the housing 101 with each other.

When a surface of the housing 101 facing the male connector 200 is referred to as a front surface and a direction that the front surface faces is referred to as a fourth direction D4, the housing 101 is provided on the front surface thereof with the groove 150 into which the projection 202 of the male connector 200 is inserted. In other words, when the projection of the male connector 200 is inserted into the groove 150 of the female connector 100, the front surface of the housing 101 faces the male connector 200. A surface opposite to the front surface of the housing 101 is referred to as a rear surface of the housing 101, and a direction opposite to the fourth direction D4 is referred to as a fifth direction D5.

The groove 150 is recessed in the housing 101 in the fifth direction D5. The groove 150 may have various sizes depending on the sizes of the male connector 200.

The signal terminal 110 is disposed on an upper surface of the groove, which is located in the first direction. The signal terminal 110 includes a conductive material to transmit electrical signals from the male connector 200 when the female connector 100 is coupled with the male connector 200.

The signal terminal 110 extends in along the fourth or fifth direction D4, D5 depending on one's point of reference and is bent at least one time. The signal terminal 110 may be manufactured by bending a metal plate after the metal plate has been pressed and extended in the predetermined direction. The signal terminal 110 includes a signal contact section 111 making contact with the signal supplying section 210 of the male connector 200 and an external extension section 113 connected with the signal contact section 111.

The signal contact section 111 extends in the fourth direction D4 from the rear to the front of the groove 150. An end of the signal contact section 111 extending in the fourth direction D4 is partially bent in the second direction D2 at 112 such that the signal contact section 111 effectively makes contact with the signal providing section 210. The signal contact section 111 is bent in the second direction D2 while being spaced apart from the top surface of the groove 150. Accordingly, the signal contact section 111 is spaced apart from the top surface of the groove 150. Since the signal contact section 111 is spaced apart from the top surface of the housing 101 by a distance, an elastic force acts on the signal contact section 111 in the second direction D2. When the male connector 200 is inserted into the groove 150, so that the signal contact section 111 moves in the first direction D1, the elastic force acts in the second direction D2. Accordingly, the signal contact section 111 stably makes contact with the signal supplying section 210 of the male connector 200.

The external extension section 113 extending in the fifth direction D5 is connected with the signal contact section 111. An end 115 of the external extension section 113 is exposed out of a surface (i.e., rear surface) of the housing 101, while another part of the section 113 passes through the housing 101. The external extension section 113 may be bent at least one time.

The end 115 of the external extension section 113, which extends in the fifth direction D5, is exposed out of the housing 101. The end 115 of the external extension section 113 is provided at a corner of the housing 101 in the vicinity of a bottom surface of the housing 101. Thus, an external device can be easily connected with the external extension section 113. For example, the external extension section 113 makes contact with a printed circuit board so that the external extension section 113 may be mounted on the printed circuit board through soldering.

The end 115 exposed to the outside of the housing 101 is electrically connected with an external cable or an external device (not shown) such as a printed circuit board through soldering. Accordingly, electrical signals can be transmitted from the male connector 200 to the external device through the signal terminal 110.

The signal contact section 111 may be integrated with the external extension section 113. If necessary, after the signal contact section 111 and the external extension section 113 have been separately manufactured, the signal contact section 111 may be coupled with the external extension section 113 through soldering, etc.

According to an embodiment of the present invention, a plurality of signal terminals 110 may be provided in a row along an internal surface of the groove 150. For example, the signal terminals 110 are arranged in the third direction D3. Referring to FIG. 2B, each signal terminal 110 includes the signal contact section 111 and the external extension section 113, and the signal terminals 110 are arranged in the third direction D3 while being spaced apart from each other with a predetermined distance. The signal terminals 110 may receive different electrical signals or the same electrical signal if necessary. The number of the signal terminals 110 may be identical to the number of the signal supplying sections 210 of the male connector 200. Therefore, when the male connector 200 is inserted into the groove 150 of the female connector 100, each signal terminal 110 makes contact with a corresponding signal supplying section 210.

When a plurality of signal terminals 110 are provided, electrical signals transmitted by the connector can be adjusted by adjusting the number of the signal terminals 110. When the number of the signal terminals is more than one, the signal terminals 110 may be arranged in a third direction D3. Alternatively, multiple signal terminals 110 may be arranged along a fourth or fifth direction D4, D5.

The grounding terminal 130 is provided on a bottom surface of the groove 150, and is spaced apart from the signal terminal 110 by a predetermined distance. The grounding terminal 130 includes a conductive material to transmit electrical signals from the male connector 200 to a grounding section of an external device when the projection 202 of the male connector 200 is inserted into the groove 150.

The grounding terminal 130 extends in a direction, such as along the fourth or fifth direction D4, D5 and is bent at least one time. The grounding terminal 130 may be manufactured by bending a metal plate after the metal plate has been processed and extended in desired direction.

The grounding terminal 130 includes a grounding contact section 131 making contact with the grounding section 230 of the male connector 200, and a grounding connection section 133 connected with the grounding contact section 131.

The grounding contact section 131 corresponds to a part of the grounding terminal 130 provided inside the groove 150 of the housing 101, on a lower surface of the groove 150.

The grounding connection section 133 extends from the grounding contact section 131 along an outer surface of the housing 101 in the fourth direction D4 and bends to extend in the second direction D2. The grounding connection section 133 may be bent at least one time along the outer surface of the housing 101. As shown in FIG. 2A, the grounding connection section 133 may surround the outer surface of the housing 101 at the side of the front surface of the housing 101. The grounding connection section 133 is bent while extending to the bottom surface of the housing 101. Accordingly, grounding is achieved by bringing the grounding connection section 133 into contact with the surface of an external device.

According to an embodiment of the present invention, the grounding connection section 133 may be provided with a grounding terminal section 135 such that the grounding connection section 133 may be connected with a grounding section of an external device such as a printed circuit board. The grounding terminal section 135 is formed in the vicinity of a corner formed between surfaces of the housing 101 which extend in the fourth and second directions D4 and D2, respectively.

As shown in FIGS. 2A and 2B, the grounding terminal section 135 may protrude from the grounding connection section 133 in the direction of the fourth direction D4 such that the grounding terminal section 135 is easily connected (e.g., soldered) with an external device. To this end, the grounding terminal section 135 may be formed by cutting a portion of the grounding connection section 133 corresponding to the front surface of the housing 101 so that the grounding terminal section 135 protrudes in the fourth direction D4.

An outer skin may be provided outside the housing 101 to surround the housing 101. The outer skin receives the housing 101 therein to protect the housing 101, the signal terminal 110, and the grounding terminal 130 from an external environment.

In the connector having the above structure, the end 115 of the external extension section 113 and the grounding terminal section 135 are disposed adjacent a bottom surface of the connector. The end 115 of the external extension section 113 is provided at the lower side of the rear surface of the housing 101, and the grounding terminal section 135 is provided at the lower side of the front surface of the housing 101. Accordingly, the grounding terminal 130 may be formed at a front side of the groove 150 of the housing 101, so that the grounding terminal 130 may be connected with a grounding section of an external device within a short distance. Accordingly, electrical signals are transmitted to the grounding section of the external device without delay.

In addition, the connector according to an embodiment of the present invention reduces electromagnetic interference (EMI) as compared to a conventional connector. In the conventional connector, since grounding sections connected with an external device are provided at both sides of a housing, for example, front and rear sides of a housing, the EMI significantly occurs at both sides of the housing. However, in the connector according to an embodiment of the present invention, a plurality of grounding terminal sections 135 are only formed at the side of the front surface of the housing 101 and connected with grounding sections of the external device to distribute an electric field, so that the EMI is remarkably reduced. Accordingly, defects caused by the EMI are reduced, and electrical signal transmission of the connector is improved.

The connector may belong to various connection apparatuses to transmit electrical signals. In particular, the connector may be used to transmit electrical signals from a controller to a display panel.

Figure 5:
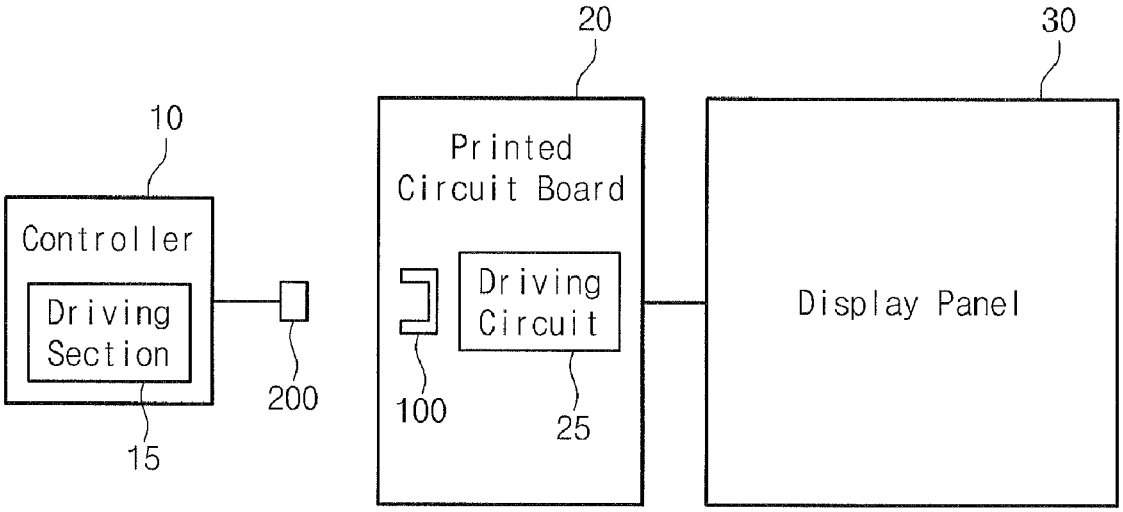
FIG. 5 is a schematic view showing a display apparatus having the connector according to an embodiment of the present invention.

A display apparatus including the connector according to an embodiment of the present invention will be described with reference to FIG. 5.

The display apparatus according to an embodiment of the present invention includes a controller 10, a printed circuit board 20, a display panel 30, and the female and male connectors 100 and 200 to connect the controller 10 with the printed circuit board 20.

The controller 10 generates image signals used to display an image. When the controller 10 provides image signals, the controller 10 may have a variety of types. One end of the printed circuit board 20 is connected with the controller 10 through the connector. A driving circuit 25 is mounted on the printed circuit board 20 to receive the image signals to drive the display panel 30. The driving circuit 25 receives the image signals to output the driving signals toward the display panel 30. The other end of the printed circuit board 20 is connected with the display panel 30 through a cable similar to the cable 240 or through a flexible printed circuit board, so that the driving signals are transmitted to a display substrate. The display apparatus having the connector includes a driving section 15 generating a signal, a male connector 200 connected with the driving section 15, a female connector 100 coupled with the male connector 200 to receive the signal from the driving section 15, a printed circuit board 20, and a display panel 30.

The male connector 200 of the connector is connected with the controller 10 through the cable 240. The female connector 100 of the connector is mounted on the printed circuit board 20.

When the female connector 100 according to an embodiment of the present invention is mounted on the printed circuit board 20, the bottom surface of the housing 101 faces the printed circuit board 20. Accordingly, the end 115 of the external extension section 113 of the signal terminal 110 and the grounding terminal section 135 of the grounding terminal 130 make contact with the printed circuit board 20.

The end 115 of the external extension section 113 and the grounding terminal section 135 are connected with corresponding positions of the printed circuit board 20 through soldering. In particular, the grounding terminal section 135 is connected with a grounding circuit of the printed circuit board 20 through soldering.

As described above, in the display apparatus according to an embodiment of the present invention, when the projection 202 of the male connector 200 is fitted into the groove 150 of the female connector 100, image signals are transmitted from the controller 10 to the printed circuit board 20 through the male and female connectors 100 and 200. The driving circuit of the printed circuit board 20 receives the image signals to output driving signals. The driving signals are transmitted to the display panel 30, such that the display panel 30 displays an image.

Figure 6A:
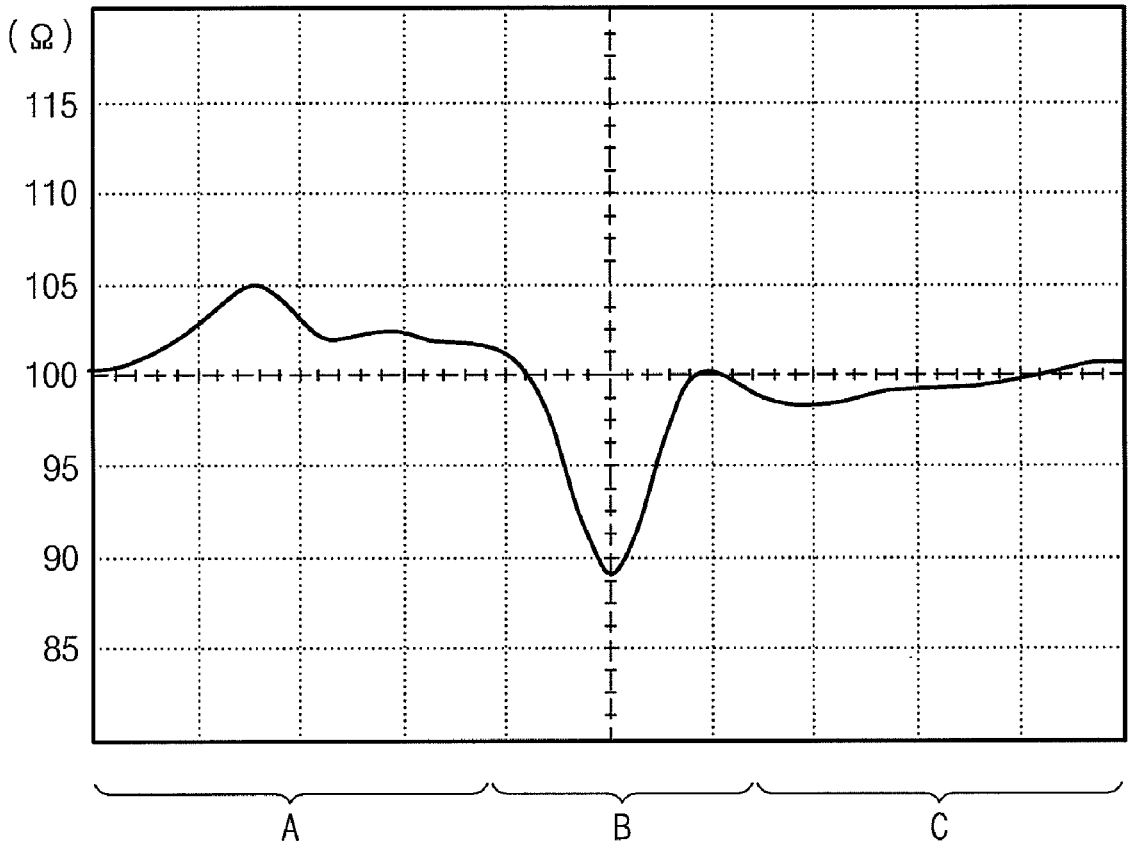
FIGS. 6A and 6B are graphs showing impedance applied to a conventional connector and a connector according to an embodiment of the present invention, respectively, and peripheral devices thereof when signals are transmitted between a controller and a printed circuit board through a conventional connector or a connector employing a 4 Gbps-transmission scheme.
Figure 6B:
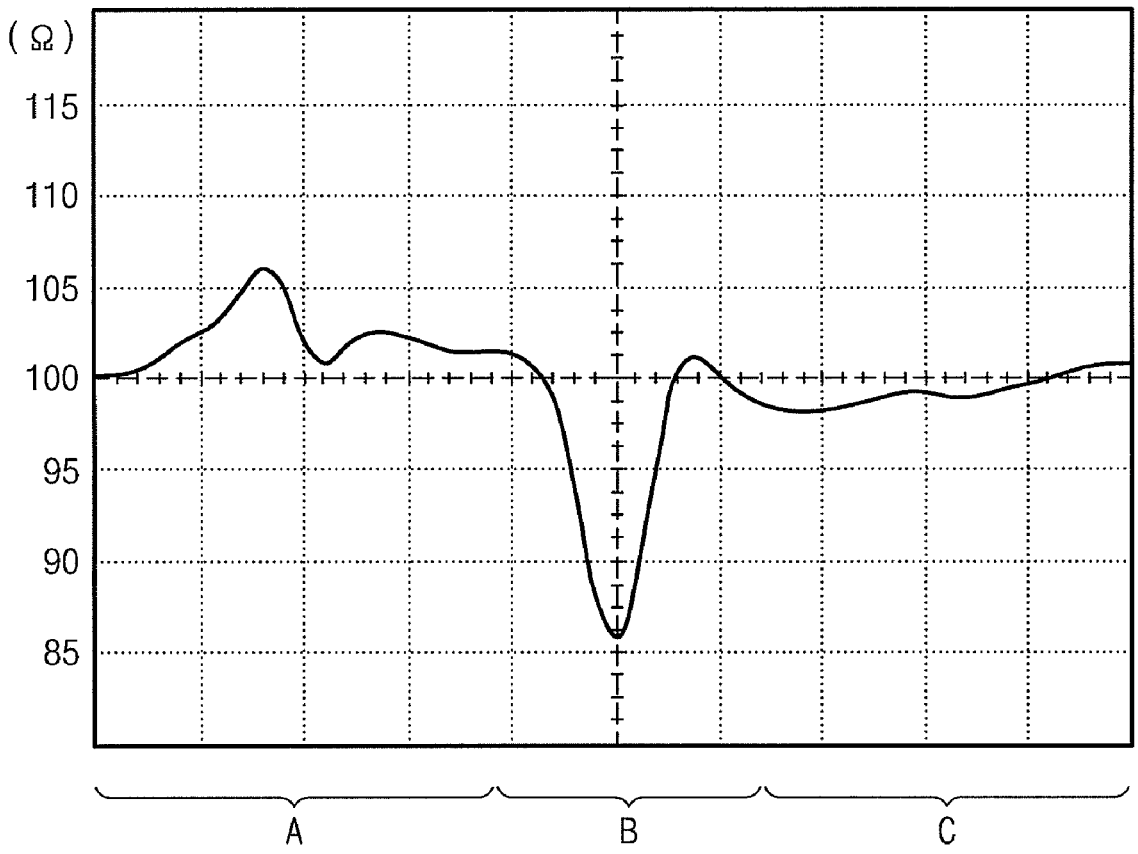

According to an embodiment of the present invention, an impedance value within a desirable range is obtained when employing the connector with the display apparatus. FIGS. 6A and 6B are graphs showing impedance applied to a conventional connector and a connector according to an embodiment of the present invention, respectively, and peripheral devices thereof when signals are transmitted through between the controller 10 and the printed circuit board 20 through a 4 Gbps-transmission scheme. In the conventional connector employed for the present data, signal terminals are placed on a bottom surface of a groove of a housing, and grounding terminals are placed on a top surface of the groove of the housing. The grounding terminals of the connector are soldered only with two ends of the connector placed in a longitudinal direction, such that the grounding terminals are connected with the printed circuit board.

Figure 7A:
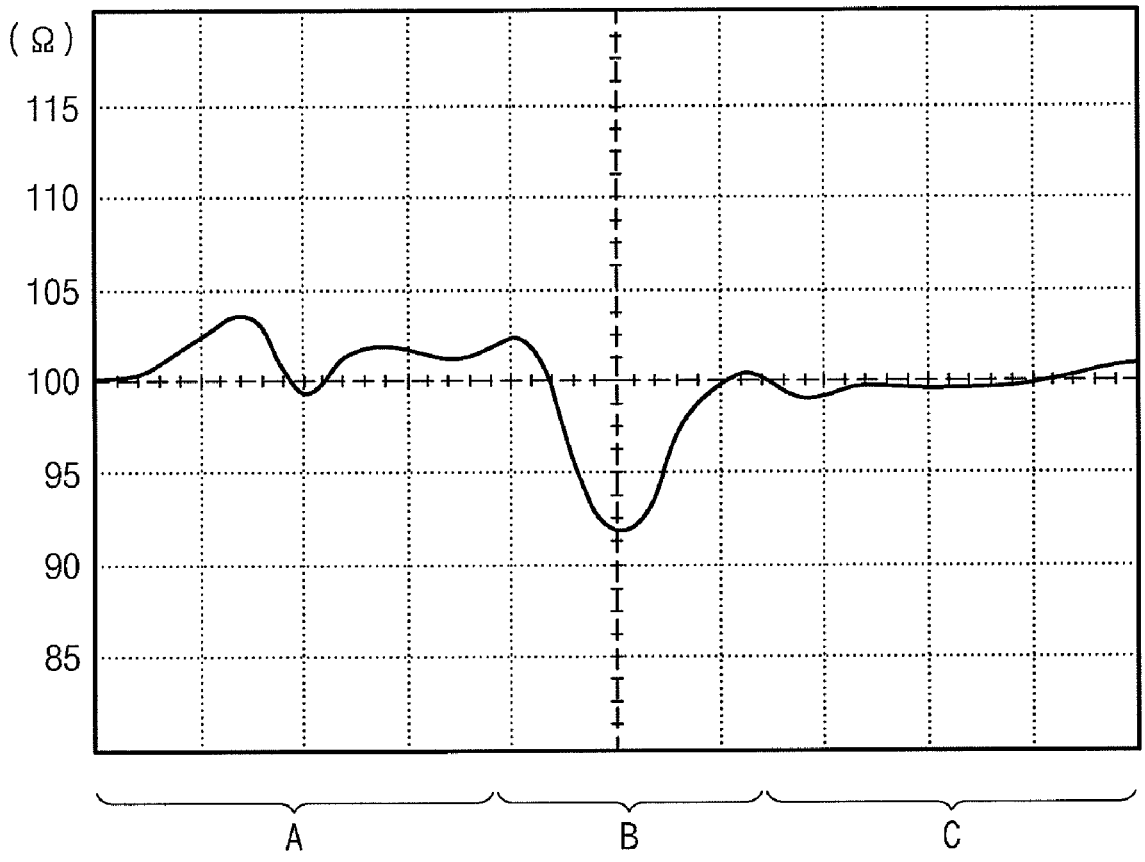
FIGS. 7A and 7B are graphs showing impedance applied to a conventional connector and a connector according to an embodiment of the present invention, respectively, and the peripheral devices thereof when signals are transmitted between the controller and the printed circuit board through a conventional connector or a connector employing a 5.4 Gbps-transmission scheme.
Figure 7B:
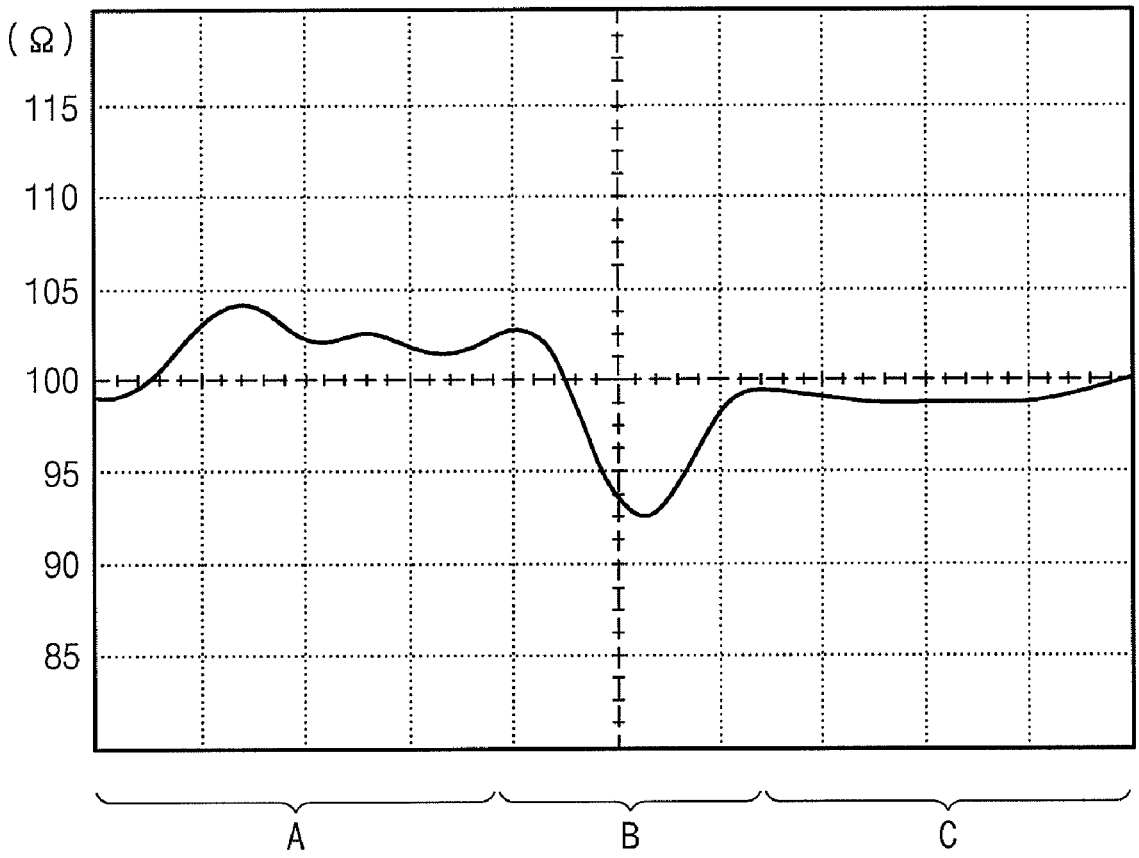

FIGS. 7A and 7B are graphs showing impedance applied to a conventional connector and a connector according to an embodiment of the present invention, respectively, and peripheral devices thereof when signals are transmitted between the controller 10 and the printed circuit board 20 through a 5 Gbps-transmission scheme. The resulting values of FIGS. 7A and 7B are obtained when the connectors of FIGS. 7A and 7B are identical to those of FIGS. 6A and 6B.

In FIGS. 6A, 6B, 7A, and 7B, an x axis represents the connector and the peripheral devices of the connector provided in areas A, B, and C according to relative distances thereof. The areas A, B, and C successively represent a printed circuit board, a connector, and a cable. Each graph sequentially shows impedance when a signal is transmitted from the connector to the printed circuit board through the connector.

In the display apparatus, the impedance between the controller and the printed circuit board may be required to be in the range of about 90Ω to about 110Ω. However, referring to FIGS. 6A and 7A, when a signal is transmitted at a data rate of about 4 Gbps by using the conventional connector, the minimum impedance is about 89.2Ω. When a signal is transmitted at a data rate of about 5 Gbps by using the conventional connector, the minimum impedance is about 85.9Ω.

In contrast, referring to FIGS. 6B and 7B, when a signal is transmitted at a data rate of about 4 Gbps by using the connector according to an embodiment of the present invention, the minimum impedance is about 92.6Ω. When a signal is transmitted at a data rate of about 5.4 Gbps by using the connector according to an embodiment of the present invention, the minimum impedance is about 91.9Ω.

As described above, when using the connector according to an embodiment of the present invention, a desirable impedance value can be obtained. Accordingly, signal transmission quality can be stably maintained, so that display quality can be improved.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A female connector for signal transmission comprising:

a housing having a groove recessed from a front surface of the housing;

a signal terminal comprising a signal contact section provided at a first wall of the groove and an external connection section connected with the signal contact section; and a grounding terminal comprising a grounding contact section provided at an opposing wall facing the first wall and a grounding connection section connected with the grounding contact section, wherein the grounding connection section extends out of the groove at the front surface of the housing, wherein the grounding connection section comprises a grounding terminal section extending in front of the front surface of the housing, wherein the grounding terminal section is adjacent a bottom surface of the housing, and wherein the grounding terminal section, the grounding connection section, and part of the grounding contact section form an h-shape in cross-section, the grounding terminal section comprising the straight portion of the h-shape.

2. The female connector of claim 1, wherein the grounding connection section has a plate-like shape, and is bent along an outer surface of the housing.

3. The female connector of claim 1, wherein a plurality of signal terminals are arranged along the first wall of the groove.

4. The female connector of claim 1, wherein an end of the external connection section is adjacent a bottom surface of the housing.

5. The female connector of claim 1, wherein the grounding contact section is substantially flush with the opposing wall.

6. The female connector of claim 5, wherein the grounding contact section extends along an entire length of the grounding terminal on the opposing wall.

7. A connector for signal transmission comprising:

a female connector having a groove; and a male connector including a projection inserted into the groove of the female connector, wherein the female connector comprises:

a housing including the groove recessed from a front surface of the housing;

a signal terminal comprising a signal contact section provided at a first wall of the groove and an external connection section connected with the signal contact section and protruding out of the housing through a rear surface of the housing; and a grounding terminal comprising a grounding contact section provided at an opposing wall facing the first wall and a grounding connection section connected with the grounding contact section, wherein the grounding connection section comprises a grounding terminal section extending in front of the front surface of the housing, wherein the grounding terminal section is adjacent a bottom surface of the housing, and wherein the grounding terminal section, the grounding connection section, and part of the grounding contact section form an h-shape in cross-section, the grounding terminal section comprising the straight portion of the h-shape.

8. The connector of claim 7, wherein the male connector comprises:

a signal supplying section making contact with the signal contact section; and a grounding section making contact with the grounding contact section while being insulated from the signal supplying section.

9. The connector of claim 8, wherein a plurality of signal terminals are arranged along the first wall, and a plurality of signal supplying sections are provided to correspond to a number of the signal terminals.

10. The connector of claim 7, wherein an end of the external connection section is adjacent a bottom surface of the housing.

11. The connector of claim 7, wherein the grounding contact section is substantially flush with the opposing wall.

12. The connector of claim 7, wherein the grounding contact section extends along an entire length of the grounding terminal on the opposing wall.

13. A display apparatus comprising:

a female connector receiving a signal from an external device;

a printed circuit board on which the female connector is mounted, and comprising a driving circuit to receive the signal from the female connector and to output a driving signal; and a display panel that displays an image according to the driving signal, wherein the female connector comprises:

a housing including a groove recessed from a front surface of the housing;

a signal terminal comprising a signal contact section provided at a first wall of the groove and an external connection section connected with the signal contact section and protruding out of the housing through a rear surface of the housing; and a grounding terminal comprising a grounding contact section provided at an opposing wall facing the first wall of the groove and a grounding connection section connected with the grounding contact section, wherein the grounding connection section extends out of the groove at the front surface of the housing, and is connected with the printed circuit board, wherein the grounding connection section comprises a grounding terminal section extending in front of the front surface of the housing, wherein the grounding terminal section is adjacent a bottom surface of the housing, and wherein the grounding terminal section, the grounding connection section, and part of the grounding contact section form an h-shape in cross-section, the grounding terminal section comprising the straight portion of the h-shape.

14. The display apparatus of claim 13, wherein the grounding connection section has a plate-like shape, and is bent along an outer surface of the housing.

15. The display apparatus of claim 13, wherein the external device includes a driving section generating the signal, and the display apparatus further comprises:

a male connector connected with the driving section, the male connector including a projection to be inserted into the groove of the female connector to transmit the signal to the female connector.

16. The display apparatus of claim 13, wherein an end of the external connection section is adjacent a bottom surface of the housing.

17. The display apparatus of claim 13, wherein the grounding contact section is substantially flush with the opposing wall.

18. The display apparatus of claim 13, wherein the grounding contact section extends along an entire length of the grounding terminal on the opposing wall.

* * * * *